United States Patent [19]

Ikeda et al.

[11] Patent Number: 5,063,757

[45] Date of Patent: Nov. 12, 1991

[54] DETERGENT DISPENSER FOR CLOTHES WASHING MACHINES OR THE LIKE

[75] Inventors: Yoshio Ikeda, Aichi; Kiyoshi Okazaki, Seto, both of Japan

[73] Assignee: Kabushiki Kaisha Toshiba, Kanagawa, Japan

[21] Appl. No.: 516,782

[22] Filed: Apr. 30, 1990

[30] Foreign Application Priority Data

| | | | |
|---|---|---|---|
| May 13, 1989 | [JP] | Japan | 1-120120 |
| May 15, 1989 | [JP] | Japan | 1-120977 |
| May 15, 1989 | [JP] | Japan | 1-120978 |
| May 16, 1989 | [JP] | Japan | 1-123656 |

[51] Int. Cl.[5] ..... D06F 29/00

[52] U.S. Cl. ..... 68/17 R; 222/651; 222/236; 222/504

[58] Field of Search ..... 222/231, 236, 238, 547, 222/564, 504, 517, 556, 545, 651, 531, 533; 68/17 R; 134/93; 198/535, 536

[56] References Cited

U.S. PATENT DOCUMENTS

| | | | |
|---|---|---|---|
| 4,207,995 | 6/1980 | Neely | 222/231 |
| 4,393,983 | 7/1983 | Eriksson | 222/564 X |
| 4,429,817 | 2/1984 | Ikeda | 68/17 R X |
| 4,779,430 | 10/1988 | Thuruta et al. | 68/17 R X |

FOREIGN PATENT DOCUMENTS

| | | | |
|---|---|---|---|
| 42-18769 | 9/1967 | Japan . | |
| 51-23272 | 6/1976 | Japan . | |
| 51-33354 | 9/1976 | Japan . | |
| 3214296 | 9/1988 | Japan | 68/17 R |
| 2051884 | 1/1981 | United Kingdom | 68/17 R |
| 2073258 | 10/1981 | United Kingdom | 68/17 R |

*Primary Examiner*—Kevin P. Shaver

*Attorney, Agent, or Firm*—Philip M. Shaw, Jr.

[57] ABSTRACT

A detergent dispenser for clothes washing machines includes a detergent container for containing a predetermined amount of powdered detergent, the detergent container having a lower discharge outlet from which the detergent contained therein is discharged and a detergent fall preventing member displaced between a first position where the detergent is prevented from falling out from the discharge outlet of the container and a second position where the detergent discharged from the discharge outlet of the detergent container is allowed to fall out therefrom.

6 Claims, 6 Drawing Sheets

DETERGENT DISPENSER FOR CLOTHES WASHING MACHINES OR THE LIKE

BACKGROUND OF THE INVENTION

This invention relates to a detergent dispenser for clothes washing machines or the like wherein a detergent or more specifically, a powdered detergent contained in a detergent container is supplied from a discharge outlet formed in the lower portion thereof, and more particularly, to such a detergent dispenser which can prevent the detergent from unavoidably falling out from the discharge outlet when the detergent need not be supplied, thereby preventing the detergent from adhering to clothes to be washed.

Conventionally, such detergent dispensers for automatically dispensing a powdered detergent into a wash tub of a clothes washing machine have been proposed. The powdered detergent is contained in a detergent container and discharged from a discharge outlet formed in the lower portion thereof, thereby dispensing the detergent into the wash tub. The discharge outlet is usually held open. As the result of such a construction, the detergent dispenser has a problem that the vibration caused during the operation of the washing machine causes the powdered detergent contained in the detergent container to fall out from the discharge outlet other than when the detergent need be dispensed. Particularly, when the powdered detergent falls out from the discharge outlet during rinsing and dehydration steps after a wash step, the detergent adheres to the clothes, which spoils the appearance of the washed clothes.

To solve the above-described problem, prior art provides a detergent dispenser having a lid or closure member for opening the discharge outlet of the detergent container when the detergent need be dispensed and closing it otherwise.

However, in the clothes washing machines and the like, dampness or moisture peculiar to the washing machines causes the powdered detergent to be hardened at the discharge outlet of the detergent container and to adhere to the container wall around the discharge outlet. Consequently, lumps of the powdered detergent are put between the discharge outlet and the closure member, resulting in incomplete closing and opening of the closure member. The powdered detergent falls out through gaps formed between the lumps of powdered detergent and the closure member. Thus, the problem that the detergent is caused to fall out from the outlet and adhere to the clothes washed has not been completely solved.

SUMMARY OF THE INVENTION

Therefore, an object of the present invention is to provide an improved detergent dispenser for clothes washing machines or the like, wherein the powdered detergent unavoidably falling out from the discharge outlet of the detergent container may be prevented from adhering to the clothes with certainty.

Another object of the invention is to provide an improved detergent dispenser for clothes washing machines or the like, wherein the powdered detergent prevented from falling out from the discharge outlet may be further prevented from being hardened.

The present invention provides a detergent dispenser for clothes washing machines or the like, comprising a detergent container for containing a predetermined amount of powdered detergent and a detergent fall preventing member. The detergent container has a discharge outlet formed in the lower portion thereof. The detergent contained in the container is discharged from the discharge outlet into a washing section. The detergent fall preventing member is disposed below the discharge outlet and displaced between a first position where the detergent is prevented from falling out from the discharge outlet of the container and a second position where the detergent discharged from the discharge outlet is allowed to fall out therefrom into the washing section.

In accordance with the detergent dispenser of the invention, the detergent unavoidably falling out from the discharge outlet of the detergent container may be prevented from further falling downwardly by the detergent fall preventing member.

Preferably, the detergent dispenser may further comprise an electric motor driven so that the detergent fall preventing member is displaced from the first to the second position, a coil spring member for urging the detergent fall preventing member so that the same is returned from the second to the first position, and a governor mechanism for retarding the detergent fall preventing member when the same is returned from the second to the first position. This arrangement allows the detergent fall preventing member to be displaced between the first and second positions without noise. Since the coil spring is employed for returning the detergent fall member from the second to the first position, the design for that purpose may be simplified.

Preferably, the detergent fall preventing member also serves as a detergent shoot for receiving the detergent discharged from the discharge outlet of the detergent container and causing the detergent to fall out therefrom. Thus, a single part may be utilized both as the detergent fall preventing member and the detergent chute.

It is preferable that the detergent dispenser further comprise a closure member for closing and opening the detergent discharge outlet of the detergent container and that the closure member may be operatively coupled with the detergent fall preventing member. A single drive source may be utilized both for displacing the detergent fall preventing member and for closing and opening the closure member.

Furthermore, it is preferable that the detergent fall preventing member have a water repellent surface on which the detergent fall preventing member receives the detergent as the detergent chute. The sliding movement of the detergent along the detergent shoot may be improved.

Furthermore, it is preferable that water be caused to flow along the detergent fall preventing member as the detergent chute so that the detergent received by the detergent fall preventing member is flown away with the water and that subsequently, the detergent fall preventing member be returned to the first position from the second position after lapse of a predetermined period from completion of the water supply. As the result of the above-described construction, the detergent fall preventing member is returned to the first position from the second position after water adherent to the detergent fall preventing member is removed therefrom. The detergent may be prevented from falling onto the detergent fall preventing member to which the water is adherent.

Other objects of the present invention will become obvious upon an understanding of the illustrative embodiment about to be described or will be indicated in the appended claims, and various advantages not referred to herein will occur to one skilled in the art upon employment of the invention in practice.

DESCRIPTION OF THE PREFERRED EMBODIMENT

Figure 1:
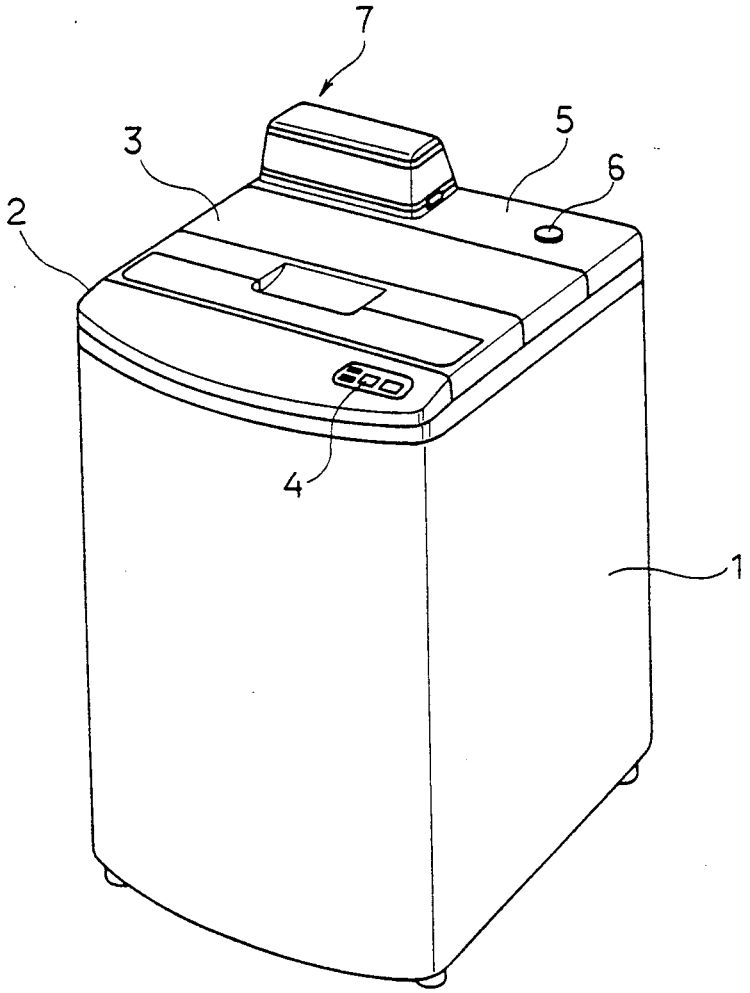
FIG. 1 is a perspective view of a full automatic washing machine to which the detergent dispenser of an embodiment is applied.

Referring to FIG. 1, a full automatic clothes washing machine is applied comprises an outer cabinet 1. A top cover 2 is mounted on the top of outer cabinet 1. A lid 3 of the folding type, an operation panel 4 and a rear panel 5 are mounted on top cover 2. A power supply switch 6 and a detergent dispenser 7 in accordance with the present invention are mounted on rear panel 5.

Figure 2:
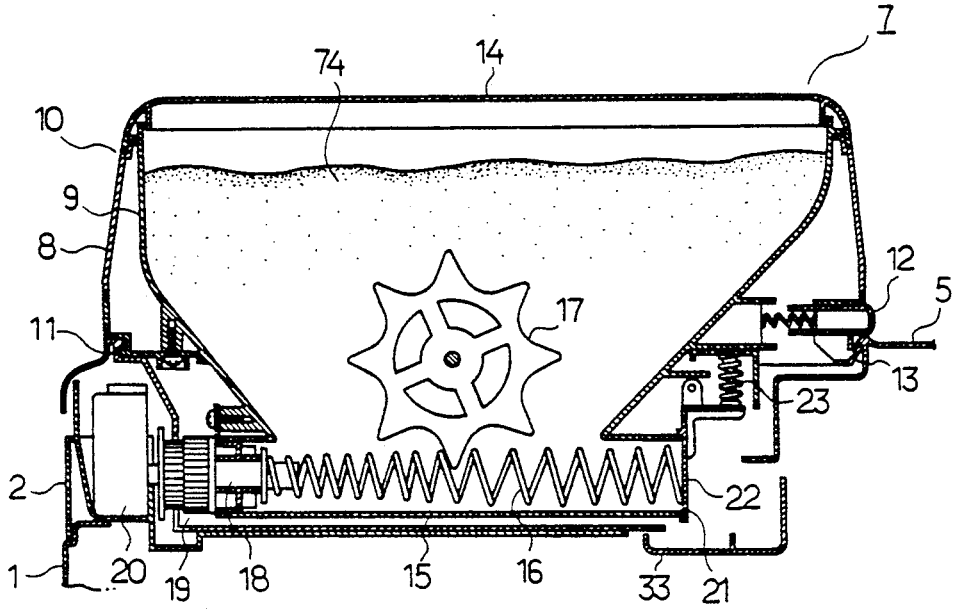
FIG. 2 is a front longitudinal sectional view of the detergent dispenser in FIG. 1.

Referring to FIG. 2, detergent dispenser 7 comprises a double-casing detergent container 10 including outer and inner casings 8 and 9. A fixed claw 11 is formed on outer wall 8 and a movable claw 13 is formed on a push button 12. Detergent container 10 is detachably mounted on rear panel 5 by way of fixed and movable claws 11 and 13. A container lid 14 closes the upper open end of detergent container 10.

A detergent discharging passageway 15 is formed at the lower end of inner casing 9. A detergent discharging member or helical coil 16 is disposed along detergent discharging passageway 15. A detergent agitating member 17 is disposed in detergent container 10 so as to be engaged with detergent discharging member 16 to be rotated. Rotation of an electric motor 20 mounted outside container 10 is transferred to detergent discharging member 16 through a selective transmission mechanism 19 and a shaft 18 disposed at the left-hand side of dispenser 7, as viewed in FIG. 2. Selective transmission mechanism 19 comprises two sets of gears having different reduction ratios from each other, for example. A detergent discharge outlet is formed at the right-hand end of detergent discharging passageway 15, as viewed in FIG. 2. A closure member or small lid 22 is mounted so as to be pivoted at its upper portion. A spring 23 is provided for applying a force to small lid 22 so that the same closes detergent discharge outlet 21.

Figure 3:
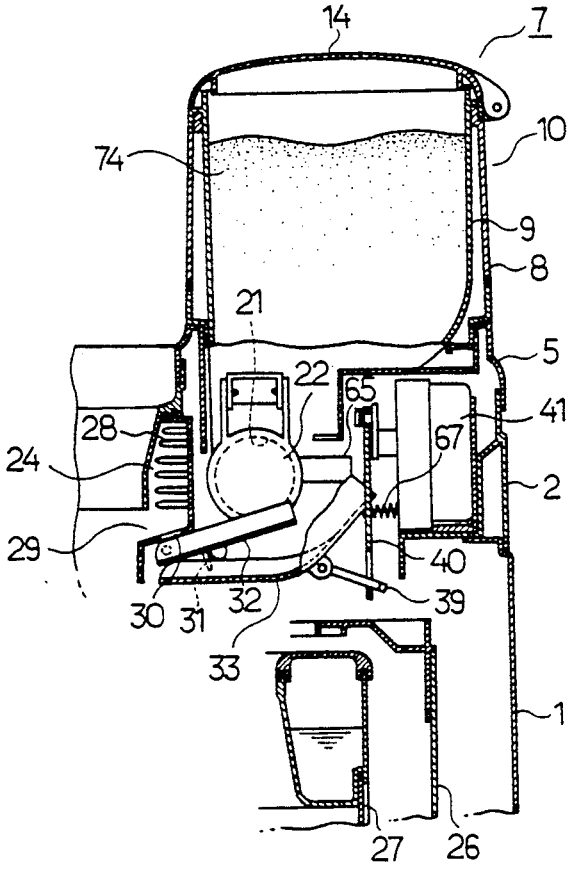
FIG. 3 is a side longitudinal sectional view of the detergent dispenser.
Figure 4:
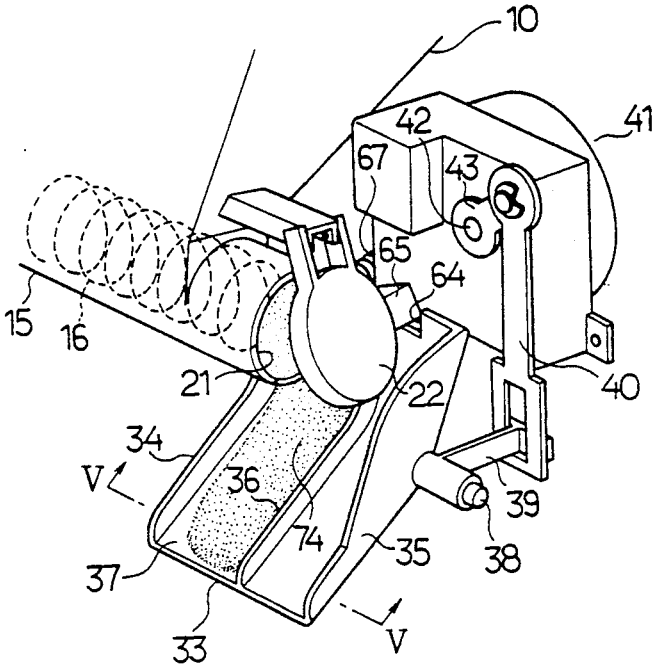
FIG. 4 is a perspective view of a detergent fall preventing member and its peripheral portion of the detergent dispenser.
Figure 5:
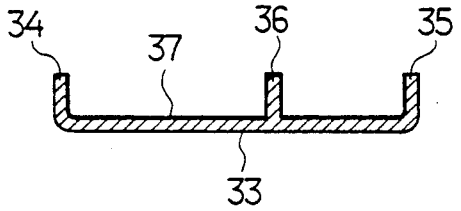
FIG. 5 is a front longitudinal sectional view of the detergent fall preventing member taken along line V—V in FIG. 4.
Figure 6:
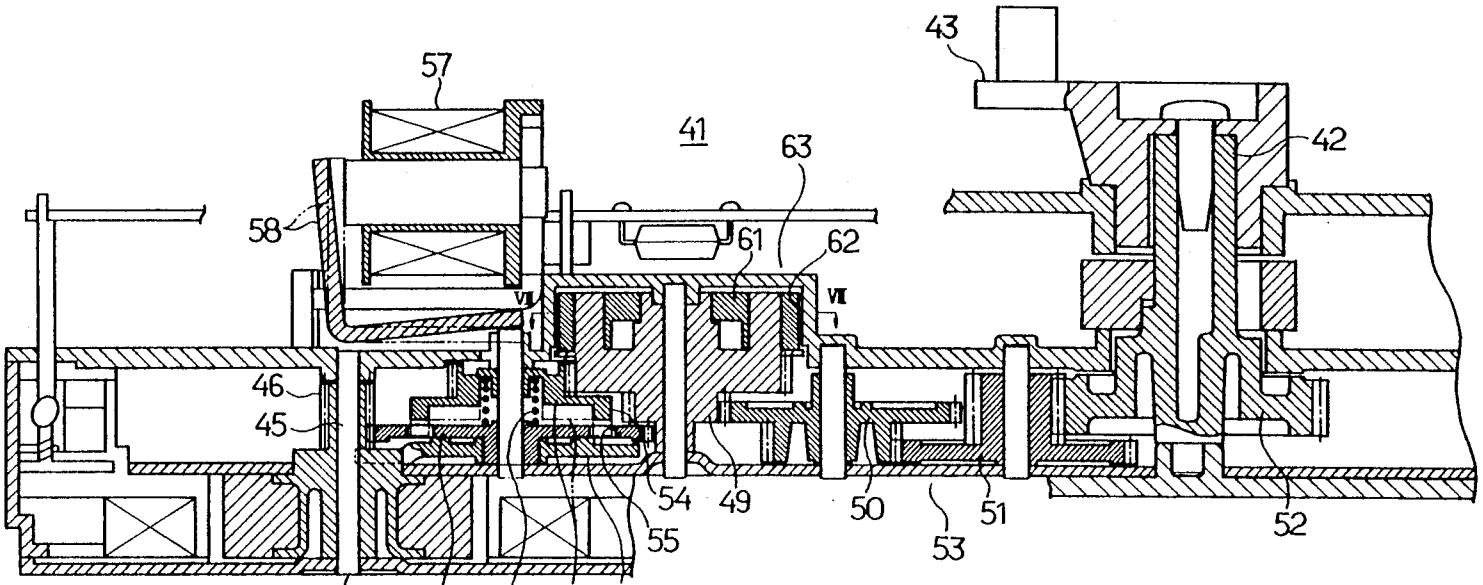
FIG. 6 is a bottom transverse sectional view of the mechanism of a drive unit.

Referring now to FIG. 3, a vessel 24 is provided in front of small lid 22. Water reservoir 24 receives water supplied through a water supply valve 25 shown in FIG. 9. The water received by vessel 24 is supplied to an inner tub 27 provided in an outer tub 26 mounted inside outer cabinet 1. Vessel 24 has a large number of comb-shaped projections 28 in its inside, a lower outlet 29 directed to the front and the other outlet 30 directed downwardly. A water guide 32 is pivotally mounted at the front edge thereof so as to extend rearwardly from the position beneath water outlet 30. Water guide 32 has a stopper rib 31 on the underside thereof. A detergent fall preventing member 33 is disposed at the further downwardly back of water guide 32. In the embodiment, detergent fall preventing member 33 also serves as a detergent supply chute. As shown in FIG. 4, detergent fall preventing member 33 has a generally shovel-like configuration and has two guide ribs 34 and 35 formed on both ends thereof respectively in the direction of its length and a central rib 36. For example, a fluorine coating is applied to the entire upper surface or detergent receiving surface of detergent fall preventing member 33, thereby forming a water repellent surface 37. A shaft 38 projects outwardly from the central back of detergent fall preventing member 33 so as to hold the same for rotative movement. Further from shaft 38, a lever 39 is extended rearwardly. The extended end of lever 39 is loosely fitted in the lower portion of a link 40. Link 40 is coupled to a crank 43 mounted on an output shaft 42 of a drive unit 41. As shown in FIG. 6, drive unit 41 encloses an electric motor 44 and a reduction gear mechanism 53 comprising first to seventh gears. In reduction gear mechanism 53, third gear 48 is positioned on second gear 47 and a projection 54 is engaged with an aperture 55 so that third gear 48 is rotated with second gear 47. Projection 54 is usually disengaged from aperture 55 by means of a spring 56 so that third gear 48 is departed from second gear 48 to be independent therefrom. A solenoid 57 is disposed over third gear 48. Upon energization, solenoid 57 moves a moving iron core 58 so that projection 54 is engaged with aperture 55, thereby rotating second and third gears 47 and 48. A one-way clutch (not shown) is formed on the underside of second gear 47. A clutch lever 59 is opposed to the one-way clutch surface. One-way clutch mechanism serves to prevent the reverse rotation of second gear 47. As shown in detail in FIG. 7, an elastic member 61 is mounted on a fourth gear 49. Elastic member 61 is formed of a material having large friction coefficient, for example, rubber. Elastic member 61 has two diametrically opposed fins 60. A brake drum 62 is disposed on the outer peripheries of both fins 60, thereby providing a governor mechanism 63.

Figure 8:
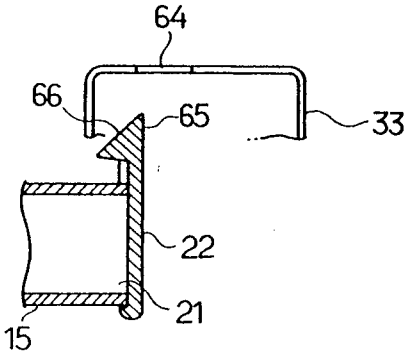
FIG. 8 is a top transverse sectional view showing the interlocking relation between a closure member and the detergent fall preventing member.

An engagement recess 64 is formed in the rear end of detergent fall preventing member 33. Engagement recess 64 is engaged with an engagement projection 65 projected from the rear of small lid 22 from downward. A portion of projection 65 in contact with projection 64 is inclined as shown in FIG. 8. A spring 67 is provided for applying a force to detergent fall preventing member 33, thereby providing detergent fall preventing member 33 with an upwardly rotating force.

Figure 9:
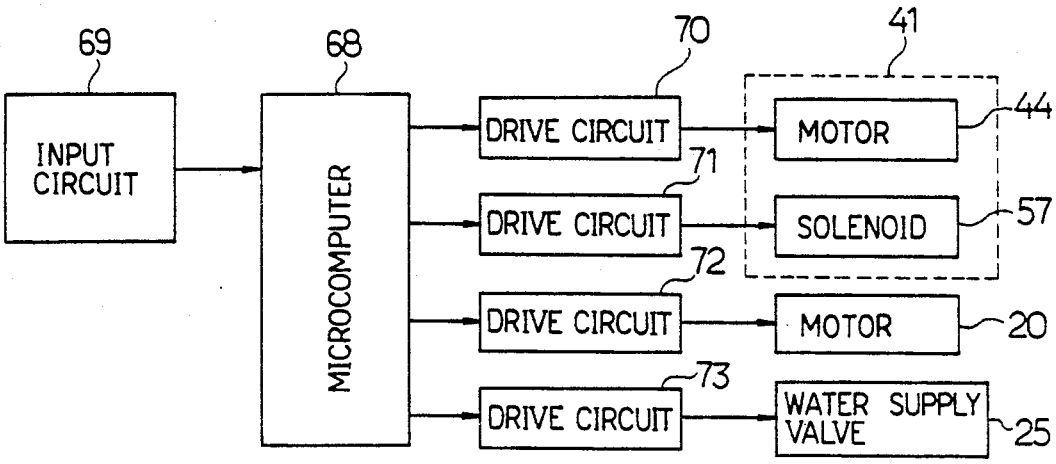
FIG. 9 is a block diagram showing an electrical arrangement of the detergent dispenser.

Referring now to FIG. 9, a microcomputer 68 serving as control means is supplied with signals from an input circuit 69 comprising a various switches. Based on the received signals and a previously stored control program, microcomputer 68 supplies control signals to a drive circuit 70 for driving motor 44 of drive unit 41, a drive circuit 71 for driving solenoid 57, a drive circuit 72 for energizing motor 20 driving detergent discharging member 16, and a drive circuit 73 for driving water supply valve 25.

Figure 10:
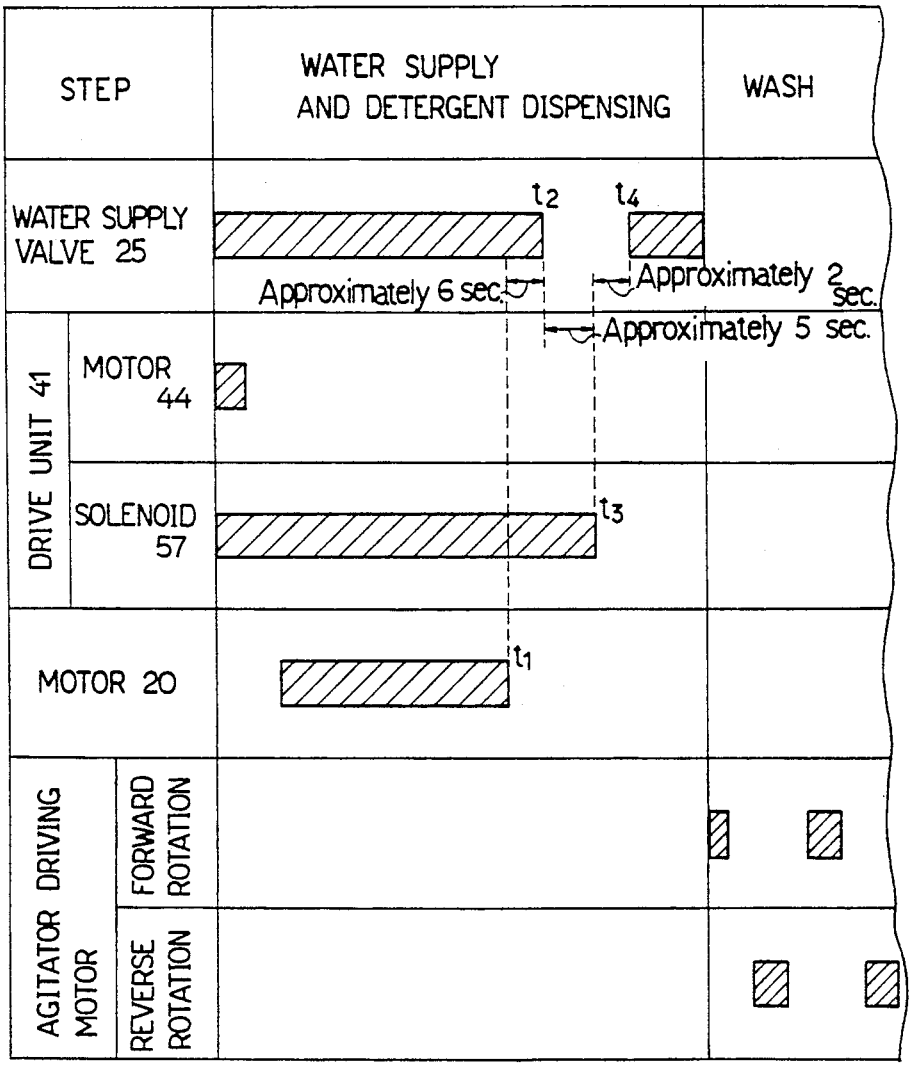
FIG. 10 is a time chart showing the case where detergent is dispensed.
Figure 11:
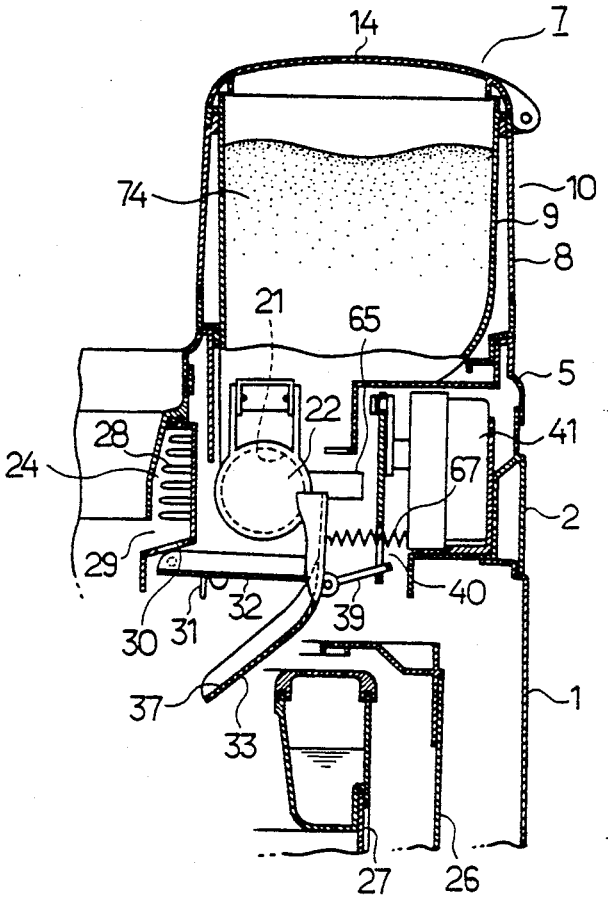
FIG. 11 is a front longitudinal sectional view of the detergent dispenser in the state that the detergent is being dispensed.
Figure 12:
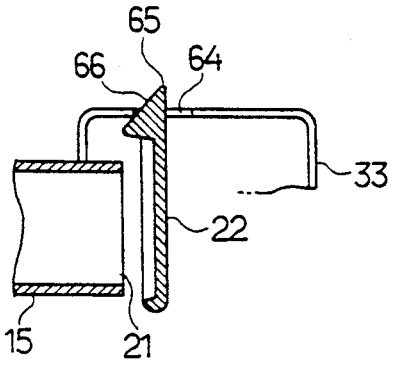
FIG. 12 is a top transverse sectional view showing the interlocking relation between the closure member and the detergent fall preventing member with the lid member opened.
Figure 13:
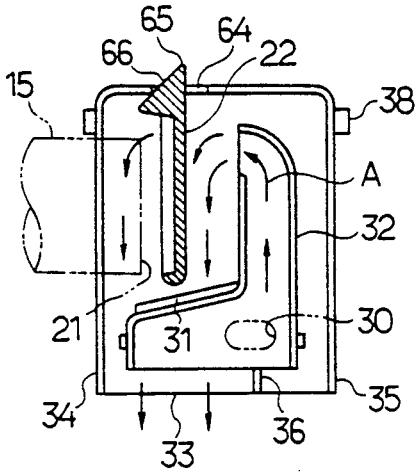
FIG. 13 is a top view of a portion of the detergent dispenser for flowing the detergent with water.

Operation of the detergent dispenser will now be described with reference to FIGS. 1 to 9 and further FIG. 10. Water supply valve 25, motor 44 of drive unit 41 and solenoid 57 are first energized in the condition that a predetermined amount of a powdered detergent 74 is contained in detergent container 10 of detergent dispenser 7. Accordingly, water supply valve 25 is opened and water is supplied to inner tub 27 through water supply valve 25 and outlet 29 in turn. Simultaneously, water is led to the front end portion of guide 32 which is inclined toward the front side of the washing machine, as shown in FIG. 3. From water guide 32 the water is also supplied to inner tub 27. Furthermore, motor 44 of drive unit 41 is driven and the motor rotation is transferred from first gear 46 to second gear 47 of reduction gear mechanism 53. Since moving core 58 of solenoid 57 energized causes third gear 48 to rotate with second gear 47, the rotation of motor 44 transferred to second gear 47 is further transferred to third gear 48 and then to fourth to seventh gears 49–52 in turn. The motor rotation is further transferred to output shaft 42 and crank 43 in turn. As a result, crank 43 is rotated to thereby raise link 40. In this regard, the rear of detergent fall preventing member 33 is inclined and the front thereof is approximately horizontal owing to force of spring 67 as shown in FIG. 3 before the motor rotation is transferred thereto. This position of detergent fall preventing member 33 is referred to as a first position. When link 40 is raised, lever portion 39 of detergent fall preventing member 33 is also raised and the same is rotatively moved about shaft 38 such that the rear is raised with the front lowered. When detergent fall preventing member 33 is rotatively moved to thereby occupy a second or most inclined position shown in FIG. 11, motor 44 of drive unit 41 is deenergized, thereby preventing further rotative movement of detergent fall preventing member 33. Moreover, upon deenergization of motor 44, spring 67 forces the gears of reduction gear mechanism 53 to reverse rotate through link 40 and crank 43 and consequently, detergent fall preventing member 33 is forced to return to the first position. However, solenoid 57 is continuously energized such that third gear 48 is caused to rotate with second gear 47. Further, since reverse rotation of second gear 47 is prevented by clutch lever 59 through one-way clutch surface, third and the other gears are not allowed to reverse rotate. Consequently, detergent fall preventing member 33 is held at the above-described most inclined position. Additionally, when the rear of detergent fall preventing member 33 is raised, engagement recess 64 is engaged with engagement projection 65 of small lid 22 and particularly, engagement recess 64 is engaged with inclined surface portion 66 of engagement projection 65 from behind downwardly as shown in FIG. 12, thereby raising inclined surface portion 66. Consequently, small lid 22 is caused to depart from outlet 21, thereby opening the same. Water guide 32 is raised by detergent fall preventing member 33 through stopper rib 31 such that the rear thereof is raised but the inclination of detergent fall preventing member 33 releases water guide 32. As a result, the rear of water guide 32 is lowered, as shown in FIG. 11. Accordingly, the water flowing out of outlet 30 of vessel 24 to water guide 32 flows rearwardly along water guide 32 as shown by arrow A in FIG. 13 and then, falls onto detergent fall preventing member 33. The water further flows along detergent fall preventing member 33 and in particular, forwardly along the path defined by guide ribs 34 and 36. Thus, the water is supplied to inner tub 27.

Subsequently, motor 20 for driving detergent discharging member 16 is energized after five minutes delay. Rotation of motor 20 is transmitted to detergent discharging member 16 through selective transmission mechanism 19, thereby rotating the same in its spiral direction. Consequently, the powdered detergent 74 contained in container 10 is forced toward outlet 21 along detergent discharging passageway 15. Since outlet 21 is opened by small lid 22, the powdered detergent 74 falls out of outlet 21 onto detergent fall preventing member 33 and in particular, onto the path defined by guide ribs 34 and 36. Powdered detergent 74 is thus received by detergent fall preventing member 33 which occupies the second or most inclined position shown in FIG. 11. Powdered detergent 74 is then led into inner tub 27 with the water flowing along the path between guide ribs 34 and 36.

Motor 20 is deenergized at time t1 (see FIG. 10) when a set period for the detergent dispensing, thereby deactivating detergent discharging member 16 and stopping the detergent feeding. Subsequently, at time t2 after lapse of about six seconds, water supply valve 25 is deenergized so that the water supply to detergent fall preventing member 33 is stopped. Thereafter, at time t3 after lapse of a predetermined period, for example, about 5 seconds with detergent fall preventing member 33 held in the inclined state, solenoid 57 of drive unit 41 is deenergized. Accordingly, third gear 48 of drive unit 41 is released from moving core 58 of solenoid 57. Then, the spring force of spring 56 causes third gear 48 to depart from second gear 47 and therefore, all the gears 49–52 of drive unit 41 is capable of being reverse rotated. Detergent fall preventing member 33 subjected to the spring force of spring 67 causes third to seventh gears 48-52 to reverse rotate through link 40 and crank 43 and is returned to the former state. Spring force also acts on small lid 22 which is returned to the outlet closing position and water guide 32 is also returned to the former state.

Figure 7:
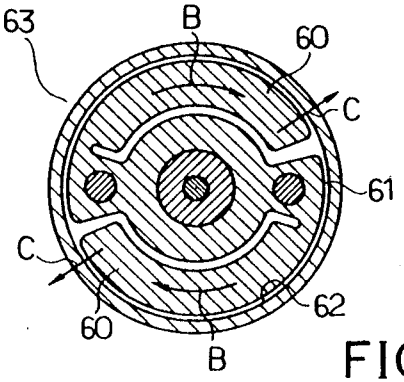
FIG. 7 is a front longitudinal sectional view of a governor mechanism taken along line VII—VII in FIG. 6.

When detergent fall preventing member 33 is returned to the first or initial position as shown in FIG. 3, fourth gear 49 being reverse rotated causes elastic member 61 of governor mechanism 63 to rotate in the direction of arrow B in FIG. 7. A centrifugal force due to rotation of elastic member 61 causes externally extended fins 60 to be pressed against the inner peripheral surface of brake drum 62, such that fins 60 are subjected to a braking force. Consequently, the reverse-rotational speed of fourth gear 49 and therefore, the return speed of fourth gear 49 or the speed at which detergent fall preventing member 33 is returned to the initial position is reduced. Accordingly, detergent fall preventing member 33 is slowly raised.

At time t4 after lapse of about 2 seconds, water supply valve 25 is reenergized and water is supplied to inner tub 27 to a predetermined level. Since water guide 32 is in the initial position with the rear raised, the water is prevented from falling onto detergent fall preventing member 33.

When the water level is reached, water supply valve 25 is deenergized and the washing operation is initiated wherein an agitator (not shown) disposed in inner tub 27 is forward and reverse rotated by an electric motor (not shown). During the washing operation and thereafter, the rear of detergent fall preventing member 33 returned to the initial position is held inclined downwardly and the front thereof is held in the horizontal state. In this state, the front of detergent fall preventing member 33 closes the lower portion of outlet 21 and detergent 74 falling through spaces formed by lumps of the powdered detergent between small lid 22 and the peripheral edge of outlet 21 is received by detergent fall preventing member 33, thereby preventing further falling of the detergent into inner tub 27. As a result, powdered detergent 74 may be prevented from adhering to the clothes which have been washed, thereby completing the washing satisfactorily. Furthermore, detergent fall preventing member 33 effectively functions to prevent water drops from inner tub 27 from splashing on detergent outlet 21.

In accordance with the above-described detergent dispenser, motor 44 is employed for moving detergent fall preventing member 33 to the second position where it allows detergent 74 to fall into inner tub 27. As a result, the noise due to shock forces as produced in the case where the electromagnet is employed conventionally is not produced. Further, spring 67 is employed for returning detergent fall preventing member 33 to the first or initial position. The design for disposition of spring 67 may be achieved easier than that for reverse rotating motor 44, thereby restraining the increase of the production cost. Furthermore, the noise due to shock forces of spring 67 may be prevented since governor mechanism 63 is employed for reducing the speed at which detergent fall preventing member 33 is returned.

Detergent fall preventing member 33 is also utilized as the detergent discharging chute for receiving powdered detergent 74 falling out from outlet 21 to thereby introduce the same to inner tub 27. Thus, a single member may be used for two purposes, which simplifies the construction of the dispenser and reduces the production cost.

Since small lid 22 is operatively coupled with detergent fall preventing member 33, two drive sources are not needed. As a result, the construction of the dispenser may be further simplified and the production cost thereof may be reduced.

Since the detergent receiving surface of detergent fall preventing member 33 utilized as the detergent discharging chute is water repellent, powdered detergent 74 may be allowed to slide on water repellent surface 37 of detergent fall preventing member 33. Consequently, the detergent dispensing may be smoothly performed and powdered detergent 74 may be prevented from affixing to the detergent receiving surface of detergent fall preventing member 33. Additionally, when the detergent is discharged with water as described above, the water may be prevented from adhering to the detergent receiving surface of member 33. Moreover, the detergent dispenser may be used satisfactorily in low water pressure regions or when the water pressure is reduced. In particular, even when a small amount of water is fed to the detergent receiving surface of detergent fall preventing member 33 after the detergent is dispensed to the inner tub, sufficient cleaning effect may be achieved.

Detergent fall preventing member 33 is returned to the initial position after lapse of a predetermined period from stop of water supply. More specifically, the water adherent to the member 33 in dispensing the detergent flows along inclined surfaces of the member 33 to thereby fall off from the same. Subsequently, the detergent fall preventing member 33 is returned to the initial position. Consequently, the detergent may be prevented from falling onto the member 33 to which water is adherent and from making detergent lumps on the member 33.

Although the fluorine coating is applied to the water receiving surface of the detergent fall preventing member to obtain water repellent surface 37, a fluorine contained resin film may be affixed to the water receiving surface of the member. Furthermore, detergent fall preventing member 33 may be formed of a fluorine contained resin. Additionally, the construction for discharging the detergent from container 10 may be changed. The detergent dispenser of the invention may be applied to dish washers and the like other than clothes washing machines.

The foregoing disclosure and drawings are merely illustrative of the principles of the present invention and are not to be interpreted in a limiting sense. The only limitation is to be determined from the appended claims.

What we claim is:

1. A detergent dispenser, for use in a clothes washing machine or the like for dispensing detergent into a clothes washing tub, comprising:

a) a detergent container for containing a predetermined amount of powdered detergent;

b) a detergent discharge passageway which communicates with the detergent container through the bottom of the detergent container so that the powdered detergent is fed from the container to the passageway, the detergent discharge passageway having a discharge outlet at one end;

c) detergent discharging means for feeding the powdered detergent in the detergent discharge passageway to the discharge outlet at a detergent dispensing step;

d) a closure member mounted at the discharge outlet and moveable between a usual, closed position at which it closes the discharge outlet and an opened position at which it opens the discharge outlet at the detergent dispensing step;

e) a detergent fall preventing member mounted beneath the discharge outlet so as to be moved between first and second positions, the detergent fall preventing member receiving the detergent from the discharge outlet when occupying the first position, thereby preventing the detergent discharged from the discharge outlet from falling to the tub, and the detergent fall preventing member, when at the second position, allowing the detergent discharged from the discharge outlet to be dispensed to the tub; and f) operating means for reciprocally moving the detergent fall preventing member between the first and second positions.

2. A detergent dispenser according to claim 1, wherein the operating means comprises an electric motor connected to the detergent fall preventing member to drive it from the first position to the second position, a spring member urging the detergent fall preventing member so that the same is moved from the second position to the first position, and a governor mechanism provided between the motor and the detergent fall preventing member for decreasing the speed of the detergent fall preventing member when the same is moved from the second position to the first position.

3. A detergent dispenser according to claim 1, wherein the detergent fall preventing member is extended from below the discharge outlet of the detergent discharge passageway to the tub and the detergent fall preventing member is inclined at the second position so that the detergent discharged from the discharge outlet is received and then slips down along the detergent fall preventing member toward the tub.

4. A detergent dispenser according to claim 1, further comprising engagement means coupling the closure member to the detergent fall preventing member for moving the closure member to the opened position in response to movement of the detergent fall preventing member from the first position to the second position.

5. A detergent dispenser according to claim 3, wherein the detergent fall preventing member has a water repellent surface along which the detergent is dispensed.

6. A detergent dispenser according to claim 3, which further comprises water supply means for supplying water to the tub through the detergent fall preventing member at the second position in a water supply operation so that water together with the detergent are supplied to the tub, the detergent fall preventing member being moved from the second position to the first position by the operating means a predetermined period of time after completion of the water supply operation by the water supply means.

* * * * *